United States Patent [19]

Norton et al.

[11] 4,088,335

[45] May 9, 1978

[54] SKATE CONSTRUCTION

[75] Inventors: Ian F. Norton, Toronto; Gerald Beekenkamp, Etobicoke, both of Canada

[73] Assignee: Greb Industries Limited, Kitchener, Canada

[21] Appl. No.: 725,190

[22] Filed: Sep. 21, 1976

[51] Int. Cl.[2] ..... A63C 1/30

[52] U.S. Cl. ..... 280/11.18

[58] Field of Search ..... 280/11.17, 11.18, 11.12, 280/11.14, 11.3

[56] References Cited

U.S. PATENT DOCUMENTS

| | | | |
|---|---|---|---|
| 678,402 | 7/1901 | Jones | 280/11.12 |
| 814,819 | 3/1906 | Willis | 280/11.12 |
| 875,905 | 1/1908 | Fletcher | 280/11.17 |
| 1,098,199 | 5/1914 | Wharrad | 280/11.12 |
| 1,771,755 | 7/1930 | Heath | 280/11.12 |
| 3,212,786 | 10/1965 | Florjancic et al. | 280/11.12 |
| 3,558,149 | 1/1971 | Weidenbacker | 280/11.12 |
| 3,866,927 | 2/1975 | Tvengsberg | 280/11.12 |
| 3,934,892 | 1/1976 | Baike | 280/11.12 |
| 3,954,278 | 5/1976 | McLeod | 280/11.12 |

FOREIGN PATENT DOCUMENTS

| | | | |
|---|---|---|---|
| 585,720 | 10/1959 | Canada | 280/11.17 |
| 908,231 | 11/1954 | Germany | 280/11.18 |
| 123,068 | 3/1959 | U.S.S.R. | 280/11.12 |

*Primary Examiner*—David M. Mitchell

*Attorney, Agent, or Firm*—Sim & McBurney

[57] ABSTRACT

This invention provides a unitary skate component extending from a blade to the sole of a skate boot. The structure has two spaced-apart walls which are vertical and substantially parallel at their lower portions and which at their upper portions curve smoothly upwardly and outwardly in opposite directions through a substantial radius to terminate in flange portions which may be attached to the boot sole. The large radius provides yieldable impact-absorbing regions without stress-concentration points.

9 Claims, 6 Drawing Figures

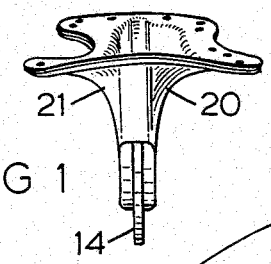
FIG 1
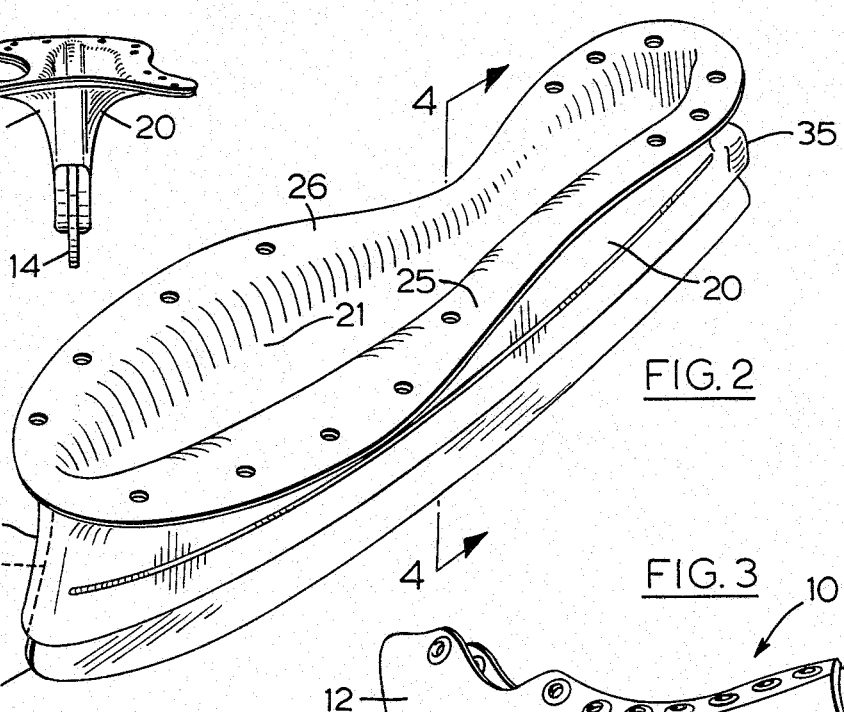
FIG. 2
FIG. 3
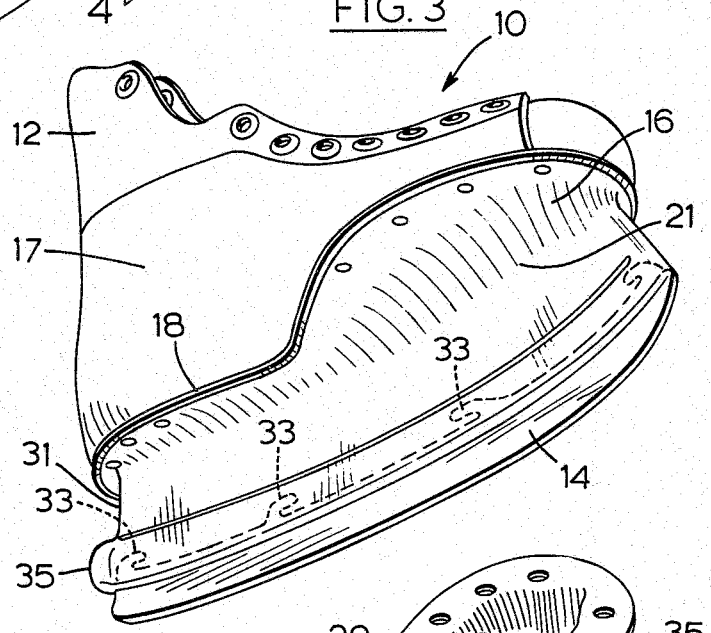
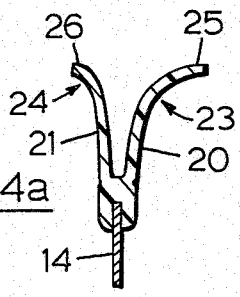
FIG. 4a
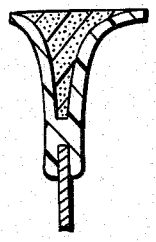
FIG. 4b
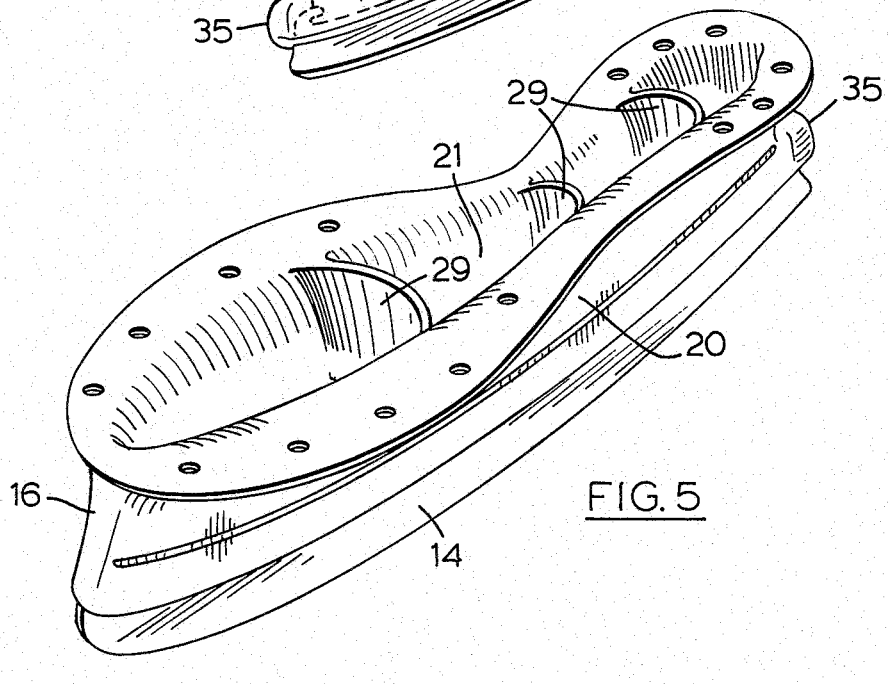
FIG. 5

SKATE CONSTRUCTION

This invention relates generally to improvements in the construction of ice skates, and has to do particularly with the construction of supporting structure adapted to extend upwardly from the runner or blade of the skate, to provide a flange area for securement to the sole of the skate boot.

This invention is generally directed to a skate construction in which the member extending upwardly from the runner is of unitary construction as seen from the exterior, and defines no openings or apertures large enough to permit the lodging of hockey sticks, pucks, etc. The prior art contains approaches to such a design, but these approaches have generally suffered from a primary disadvantage relating to the particular design of the part extending upwardly from the blade. Exemplary of the prior art are U.S. Pat. No. 875,905, Fletcher, dated Jan. 7, 1908 and U.S. Pat. No. 3,934,892, Baikie, dated Jan. 27, 1976.

The common approach to the construction of the unitary member extending upwardly from the runner, as exemplified in the aforementioned patents, involves the provision of a member which is substantially triangular in section, with two relatively flat or rectilinear walls (as seen in vertical transverse section) extending upwardly from a triangular vertex located at the runner, to a triangular "base" constituted by the sole of the boot. Thus, the prior art construction has involved a kind of inverted-triangular configuration with the boot sole being the base and the blade being the vertex opposite the base.

A primary difficulty with this kind of construction is its relative inflexibility and inability to absorb impacts during hard use without the development of high stress concentration points.

In the typical triangular construction of the prior art, the triangular, upwardly diverging walls extending from the blade terminate in an abrupt angle to define outwardly extending peripheral flange areas utilized for the securement of the support structure to the underside of the boot sole. As is well known in mechanics, the triangular structure is extremely rigid. While this is of advantage in certain applications in the construction industry and other areas, its use for the section of the supporting structure for a skate leads to such a degree of inflexibility, that rupture through repeated stress concentration under impact can result. There is simply no allowance in the rigid triangular construction for any yield or "give" in the wall which might allow the structure resiliently to absorb some of the energy of an impact, and it is generally an extremely difficult matter to avoid stress concentration in constructions which involve sharp-angled bends.

It is with the foregoing disadvantages of the prior art approach to the problem that the present invention has been developed.

Accordingly, this invention provides a unitary skate component comprising a runner and a supporting structure of moldable resilient plastic material extending from said runner up to the underside of the sole of a skate boot, said runner having irregularities along its upper edge, said structure including a lower portion closely surrounding and gripping the upper portion of said runner including said irregularities, thereby to effect a secure grip therewith, two walls continuous throughout the length of the skate, the walls being integral with said lower portion and extending upwardly therefrom in spaced apart relation, the walls being substantially parallel and vertical where they join the lower portion whereby the supporting structure achieves columnar supporting strength, the walls then curving smoothly upwardly and outwardly through a large radius comparable in length to the vertical depth of the runner to terminate in flange portions extending generally away from each other, thereby to provide yieldable impact-absorbing regions without stress-concentration points and without reverse curves, the two walls curving smoothly together at the front and at the rear.

Three embodiments of this invention are illustrated in the accompanying drawings, in which like numerals denote like parts throughout the several views, and in which:

FIG. 1 is a front elevational view of the supporting structure and runner of this invention;

FIG. 2 is a perspective view of the item of FIG. 1;

FIG. 3 is another perspective view of the supporting structure, complete with a skate boot;

FIG. 4*a* is a transverse vertical sectional view taken along the line 4—4 of FIG. 2;

FIG. 4*b* is a view similar to FIG. 4*a*, but showing an alternate embodiment of this invention; and FIG. 5 is a view similar to FIG. 2, but showing yet another embodiment of this invention.

Turning to the figures, there is illustrated in FIG. 3 a complete ice skate 10 including a skate boot 12, a runner 14 and a supporting structure 16 extending from the runner 14 to the skate boot 12. In the industry, the supporting structure 16 is normally termed the "blade" but the terminology "supporting structure" will be used throughout this disclosure to avoid confusion with the standard use of the term "blade."

The skate boot 12 can be seen to consist of the usual upper 17 and sole 18.

The first embodiment of the supporting structure 16 is best seen by inspecting FIGS. 1, 2, 3 and 4*a*. The structure 16 extends from the runner 14 upwardly to the sole 18 of the skate boot, and includes two spaced-apart walls 20 and 21 of resilient material, preferably a high-impact, relatively stiff but resiliently yieldable plastic such as a polycarbonate. The walls 20 and 21 are continuous throughout the length of the skate, and extend substantially vertically upwardly from their junction with the runner 14 at the lower portion, such that they are substantially parallel adjacent the runner. This parallelism can be seen very well in FIGS. 1 and 4*a* at the lower portion adjacent the runner 14. This vertical parallelism of the walls provides columnar supporting strength for the skate as a whole, in accordance with the well known strength of vertical members in compression. At their upper portions, the walls 20 and 21 curve smoothly upwardly and outwardly through substantial radii 23 and 24 respectively, to terminate in flange portions 25 and 26 respectively which extend generally away from each other. In the preferred embodiment of this invention, the flange portions 25 and 26 have their end portions extending obliquely outwardly and upwardly in order to add an additional resilient, impact-absorbing capability to the supporting structure 16. This outward and upward oblique slope is seen best in FIG. 4*a*. It will thus be seen that the provision of the radii 23 and 24 provides a yieldable impact-absorbing region in the supporting structure 16 which is completely without stress-concentration points. The ability of the tough but somewhat resilient plastic material to undergo flexure at the radii 23 and 24 allows several degrees of movement of the runner 14 with respect to the skate boot 12 without giving rise to any stress concentration. In the first place, the runner 14 can move from side to side in a transverse motion under the forces developed in the skate when the skater attempts to turn abruptly, or when the runner 14 or the lower portion of the structure 16 is struck by a puck or a hockey stick from the side. Secondly, upward force exerted on the structure 16 by the runner 14, as when the skater jumps on the ice, can also be absorbed without causing any stress concentration. The radii 23 and 24 can both decrease their curvature slightly to absorb an upward movement of the runner 14 with respect to the skate boot 12. Equally importantly, however, the vertical orientation of the lower parts of the two walls 20 and 21, where they are parallel and spaced from each other, provides a columnar strength enabling the walls to resist the upward force of the runner 14 and to transmit this upward force smoothly to the skate boot.

The volume defined between the walls 20 and 21 is seen in FIG. 4*a* to be slightly upwardly diverging in its lower region. This has only been provided due to certain moulding considerations, where a slight rake or slope is required to permit an insert to be removed after the plastic has solidified. Ideally, the least possible rake should be utilized, in order to allow the walls 20 and 21 to be substantially parallel at the lower end.

FIG. 4*b* shows the second embodiment of this invention in transverse vertical section, wherein the volume or pocket defined between the walls 20 and 21 is filled with a cellular, stiff but impact-absorbing material such as a polyurethane. It is to be understood that the entirety of the space defined within the walls 20 and 21 would be filled with this material.

The third embodiment of this invention is illustrated in FIG. 5, in which the volume defined between the wall 20 and 21 contains a plurality of transverse, arcuate partitions 29 which are integral with the walls 20 and 21 on their inner surfaces, and which are provided for the purpose of increasing the impact-absorbing characteristic of the structure 16.

At the front and the rear of the skate, the two walls 20 and 21 curve smoothly together to define relatively blunt front and rear surfaces 30 and 31, respectively.

The nature of the interlock between the runner 14 and the lower end of the supporting structure 16 can be seen in broken line in FIG. 3. The upper edge of the runner 14 is shaped to define a plurality of upward projections 33 in spaced relation. In the embodiment shown, there are four upward projections, although it is considered that a minimum of three will provide the necessary gripping strength and the advantages of the particular shapes illustrated. As seen in FIG. 3, each extreme projection is hooked toward the middle of the runner 14 but is not hooked away from the middle. The two intermediate projections are also hooked toward the middle but not away from the middle. It will be understood that the material at the bottom of the supporting structure closely surrounds the upper part of the runner 14 including all of the upward projections 33, whereby to provide a firm grip between the runner 14 and the supporting structure 16.

The reason for the one-way hooks of the projections 33 has to do with contraction and expansion under temperature changes.

In the case where the supporting structure 16 is moulded with the runner 14 in place, i.e. where the supporting structure 16 is entirely integral, the plastic around the projections 33 solidifies at a relatively high temperature. The runner 14 is also at the same temperature during the moulding procedure.

However, as the combination of the supporting structure 16 and the runner 14 cool down to room temperature, and particularly when they are in use in a cold hockey rink or outdoors in winter, there will be considerable contraction of both portions due to the drop in temperature. The metal of the runner 14 and the plastic material have different coefficients of thermal expansion and contraction, however, and for this reason it is normally expected that the plastic 16 will contract to a greater degree than the runner 14 for a given drop in temperature. By having the projections 33 hooked always toward the middle, the plastic of the supporting structure 16 is allowed to ride up over the outlying slope of each projection 33 to a slight extent during contraction, thereby reducing the thermal stresses which would otherwise be caused. This construction permits the structure 16 to absorb greater energy during impact and hard play than would otherwise be the case.

Finally, it can be seen in FIGS. 2, 3 and 5 that the supporting structure 16 defines, at its lower rearward end, a protuberance 35 which overhangs the rearward end of the runner 14. The provision of this protuberance 35 is largely to protect others from injury due to impact by the rear part of the runner 14, but the protuberance 35 typically receives a number of impacts itself during hockey games. For this reason, the protuberance 35 constitutes a portion of the structure 16 which is more likely than other parts to be broken, ruptured or fractured.

As an alternative to the integral construction for the supporting structure 16 in which all portions are moulded as a single unit, it is possible to form the two walls 20 and 21 as separate pieces, shaped to meet along a vertical plane which longitudinally bisects the runner 14, and which is identified by the broken line 40 in FIG. 2. In such case, the lower marginal portions of each separate wall would be shaped to define formed cavities adapted to closely surround and grip the upward projections 33 of the runner 14.

We claim:

1. A unitary skate component comprising a runner and supporting structure extending from said runner up to the sole of a skate boot, said structure including two spaced-apart walls of moldable, resilient material continuous thoughout the length of the skate, the walls extending substantially vertically upwardly from their junction with the runner and being substantially parallel adjacent the runner, thereby to provide columnar supporting strength for the skate, the walls at their upper portions curving smoothly upwardly and outwardly through a substantial radius to terminate in flange portions extending generally away from each other, thereby to provide yieldable impact-absorbing regions without stress-concentration points, the two walls curving smoothly together at the front and the rear, the runner being shaped to define at least three upward projections in spaced relation along its upper edge, each extreme projection being hooked toward the middle of the runner, the walls coming together at the bottom of the supporting structure and providing material closely surrounding the upper part of the runner including all said upward projections, whereby to provide a grip between said runner and the supporting structure.

2. The invention claimed in claim 1, in which the supporting structure defines a rearward protuberance at the rear overhanging the rear end of the runner.

3. The invention claimed in claim 1, in which the walls are integral at the bottom.

4. The invention claimed in claim 1, in which the walls are separate from each other and come together at the bottom and at the front and rear in face-to-face contact along a plane longitudinally bisecting the runner.

5. The invention claimed in claim 1, in which the walls are integral with each other at the junction with the runner and at both the front and the rear of the skate.

6. The invention claimed in claim 1, in which the walls are formed as separate pieces which come into contact at the bottom and at the front and rear along a plane longitudinally bisecting the runner.

7. The invention claimed in claim 1, in which the volume defined between the walls is filled with a cellular, resilient, impact-absorbing material.

8. The invention claimed in claim 1, in which the volume defined between the walls contains a plurality of partitions curved in horizontal corss-section and bridging between the walls, serving as additional impact-absorbing members.

9. The invention claimed in claim 1, in which said flange portions slope obliquely upward away from each other, to provide additional impact-absorbing structure.

* * * * *